US007100411B2

(12) United States Patent
Lentz et al.

(10) Patent No.: US 7,100,411 B2
(45) Date of Patent: Sep. 5, 2006

(54) DEVICE FOR RESHAPING AND/OR FOLDING BODIES OF CANS

(75) Inventors: Norbert Lentz, Essen (DE); Steffen Rötz, Essen (DE)

(73) Assignee: SIG Cantec GmbH & Co. KG, Essen (DE)

( * ) Notice: Subject to any disclaimer, the term of this patent is extended or adjusted under 35 U.S.C. 154(b) by 0 days.

(21) Appl. No.: 10/506,319

(22) PCT Filed: Feb. 20, 2003

(86) PCT No.: PCT/DE03/00528

§ 371 (c)(1),
(2), (4) Date: Sep. 1, 2004

(87) PCT Pub. No.: WO03/074208

PCT Pub. Date: Sep. 12, 2003

(65) Prior Publication Data

US 2005/0103076 A1 May 19, 2005

(30) Foreign Application Priority Data

Mar. 1, 2002 (DE) ..... 102 09 154

(51) Int. Cl.
*B21D 15/04* (2006.01)

(52) U.S. Cl. ..... 72/105; 72/10.3; 72/31.07; 72/94

(58) Field of Classification Search ..... 72/8.3, 72/9.5, 10.3, 10.4, 11.1, 12.1, 31.07, 94, 102, 72/105, 108
See application file for complete search history.

(56) References Cited

U.S. PATENT DOCUMENTS

| | | | | | |
|---|---|---|---|---|---|
| 4,019,356 | A | * | 4/1977 | Bohl | 72/30.1 |
| 4,366,691 | A | * | 1/1983 | Schafer | 72/84 |
| 4,487,048 | A | * | 12/1984 | Frei | 72/94 |
| 4,606,207 | A | | 8/1986 | Slade | |
| 4,869,088 | A | * | 9/1989 | Kadotani | 72/11.1 |
| 5,333,480 | A | * | 8/1994 | Berstein | 72/110 |
| 5,349,836 | A | | 9/1994 | Lee | |
| 5,528,917 | A | * | 6/1996 | Bajraszewski et al. | 72/10.6 |
| 5,653,138 | A | | 8/1997 | Kruger | |

FOREIGN PATENT DOCUMENTS

| | | |
|---|---|---|
| DE | 259 362 | 8/1988 |
| DE | 37 11 927 | 10/1988 |
| DE | 43 13 451 | 10/1994 |
| EP | 0 113 248 | 7/1984 |
| EP | 0 588 048 | 3/1994 |
| EP | 0 772 501 | 5/1997 |

* cited by examiner

*Primary Examiner*—Ed Tolan
(74) *Attorney, Agent, or Firm*—Andrew Wilford

(57) ABSTRACT

A can body is fitted to an inner shaping tool rotatable adjacent a freely rotatable outer shaping tool outside the can body. An arm having an outer end rotatably carrying the outer shaping tool and an inner end is pivotal about its inner end. The inner tool and the can body fitted thereto are rotated to entrain and rotate the outer tool. A motor controlledly pivots the arm and thereby moves the outer shaping tool toward and away from the inner shaping tool. A position detector connected to arm senses the angular position thereof and the relative spacing of the inner and outer tools. A controller including a memory controls the motor in accordance with a sensed angular position of the arm.

11 Claims, 3 Drawing Sheets

DEVICE FOR RESHAPING AND/OR FOLDING BODIES OF CANS

CROSS REFERENCE TO RELATED APPLICATIONS

This application is the US national phase of PCT application PCT/DE03/00528, filed 20 Feb. 2003, published 12 Sep. 2003 as WO 03/074208, and claiming the priority of German patent application 10209154.4 itself filed 1 Mar. 2002.

FIELD OF THE INVENTION

The invention relates to an apparatus for shaping and/or folding can bodies having at least two oppositely rotating shaping tools of which one is mounted on an arm for radial movement.

BACKGROUND OF THE INVENTION

Such apparatuses are used for necking or grooving can bodies. For necking, a can body is reduced in diameter at one or both ends so that the diameters of the top and bottom ends of the can are made smaller.

Grooving entails inserting a cam-controlled profiled inner tool into the end of the can body and then rolling it off against an annular internally profiled outer tool so that the groove profile is imparted to the wall of the can-body end. Grooving serves for increasing the resistance to implosion of a filled can that is internally pressurized and filled hot and then cooled, so that the can interior is depressurized after cooling.

An example of an apparatus for forming a necked or grooved section at an end of a can body is shown in EP 0,772,501 (U.S. Pat. No. 5,653,138). Here two axially movable inner tools of which at least one is made to rotate, and with a shape corresponding to the necked and edged end are used with an outer shaping tool movable radially inward against the inner tools, which are mounted on separate coaxial shafts and which are mounted on their shafts so that they are braced against axial shifting. The region holding the cylindrical work piece of at least one of the inner tools has a radially effective clamping system that is pressed against the inner surface of the cylindrical body. The outer shaping tool is pressed for forming the necked or edged end against the profile of the inner tool such that the two inner tools shift axially apart. The radial displacement of the second tool is effected by a pivoted arm that is provided according to EP 0,772,501 with a follower roller that engages in a stationary cam groove. This cam drive moves the outer shaping tool drive inward toward and outward away from the common axes of the inner tools. Alternatively instead of the pivot arm it is possible to use an eccentric. The control cam determines the pivot arc, the type of movement—linear, progressive, degressive, or other—of the tool as well as the actual coordinates of the position of the movable tool, in particular the starting and ending points of the pivotal movement relative to the inner tools, which are usually rotatable but radially nonmovable and axially shiftable.

In order to accommodate variations in the workpiece reflected in the end position of the movable shaping tool, the shaping tool must be radially adjustable on the pivot arm. The cost of the mechanical parts for the pivot arm with an adjustable tool are considerable. Setting the shaping tool on the pivot arm or of the shaping tools on the pivot arms takes up quite some time.

In particular with multiple-head machines with plural shaping tools on change of the can diameter of the workpiece at least the shaping rollers must be changed in order to get the necessary geometry. The type of movement, that is for example linear progressive or degressive, as well as the control positions are not changeable. The pivot-arm movement is dictated by the mechanism even when there is no workpiece on the inner tool. Change in format requires an expensive switching of the mechanical drive.

OBJECT OF THE INVENTION

It is an object of the invention to improve on the above-described apparatus such that it can be set more quickly and more flexibly, in particular with respect to the movement parameters:

- pivot arc (stroke),
- movement type (linear, progressive, degressive, etc.),
- control positions (starting and ending points of pivotal action), and
- execution of the pivoting.

SUMMARY OF THE INVENTION

This object is achieved by the apparatus in that the arm is provided with a controllable drive comprised of a motor with or without a step-down drive and an increment or angle sensor. The arm is preferably, as already known from the state of the art, pivotal; it can also be linearly guided.

In order to be able to perform two different operations, one right after the other, according to a further embodiment of the invention each pivot arm is provided with two tools that are used alternately for shaping.

Preferably a calibrating body in provided, in particular a calibrating ring, that serves after changing of the shaping tool as a reference point for setting the increment or angle sensor at a null point.

In particular the apparatus can be set up as a multiple-spindle carousel-type machine wherein each arm is connected with a respective externally controllable drive so that a standard prior-art numeric controller can take care of all of the settings for the shaping tools.

In mass-production systems for cans quality control of the finished product is critical in order to prevent production of defective products. Determining which workpieces are bad should be done at the earliest possible stage so that the bad workpieces can be culled out as soon as possible. To this end according to a further embodiment of the present invention the apparatus is set up such that the change in the actual-value current output of the electrical drive relative to the angular position and the force curve derived from it are compared with a stored force curve and when a predetermined deviation is detected the respective can body is culled out.

Such early detection of product defects can also be used to direct a defect-detected signal to the defect-creating device, so as in some situations to shut it down. Preferably in this situation there is a one-to-one relationship with the tool creating the problem.

To this end the apparatus has a memory for the force curves of typical error situations. The force curve for an error-free shaping or folding operation (taking into account a permissible tolerance range) is in fact determined by the tool and workpiece and is in normal processes largely constant. On the other hand particular setting and wear-dependent errors lead to a change in the physical parameters, in particular the loss of force in shaping or folding operations that are very similar so that references can be drawn back to the concrete errors from the changes of the force curve. If a teach-in function is used to program in the force curves by standard or acceptable errors or errors created by certain problems, it becomes possible to generate an early warning signal to a machine operator or to affect the machine operation. Measuring and storing the physical parameters of the drive thus makes it possible to determine the quality of the process.

BRIEF DESCRIPTION OF THE DRAWING

Further advantages and embodiments of the invention are described in the following with reference to the drawing. Therein.

SPECIFIC DESCRIPTION

Figure 1:
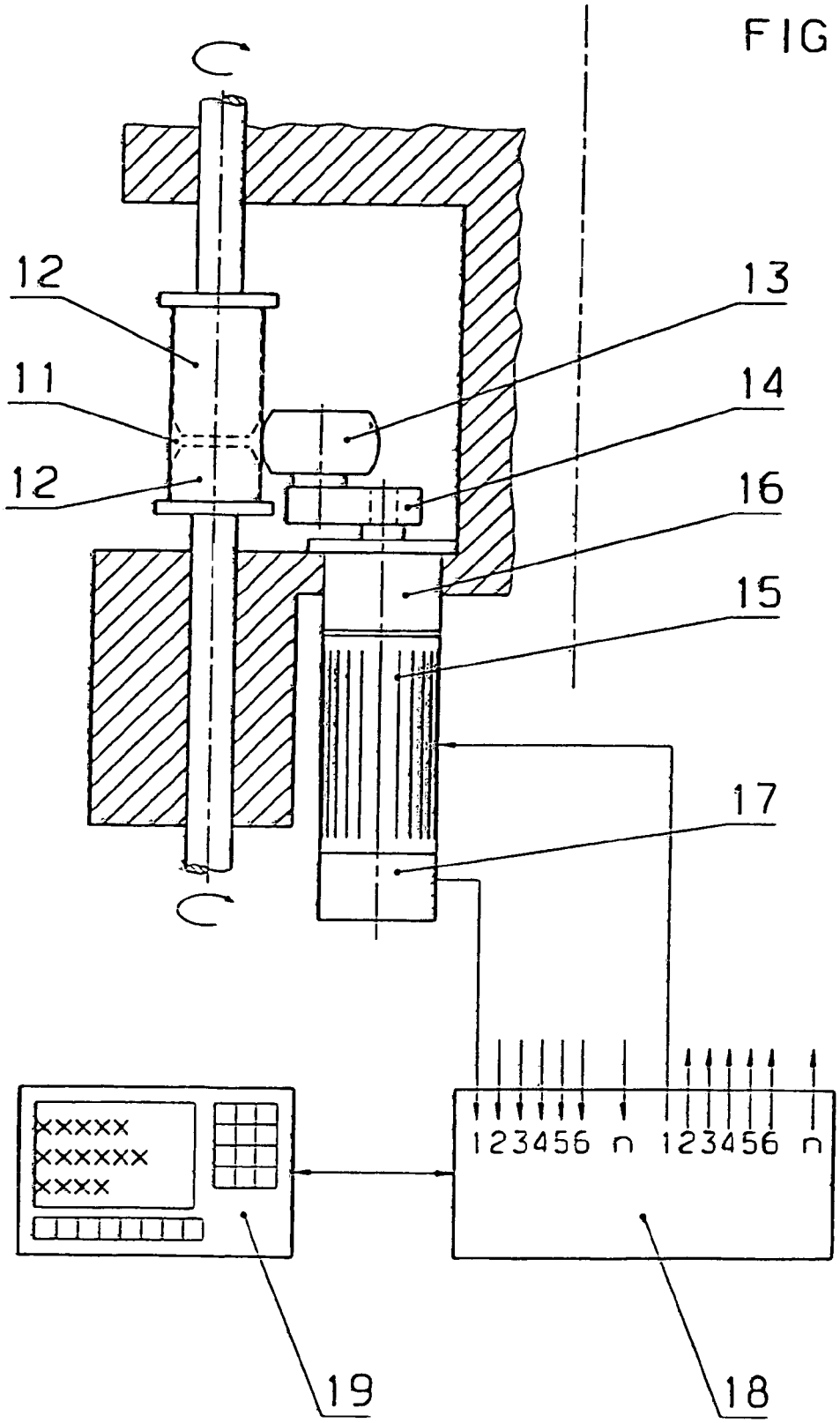
FIG. 1 is a schematic side view of a control drive with pivot arm.

As shown schematically in FIG. 1 a can body 11 is fitted to and fixed on one internal tool or, as in this case, on two inner tools 12 fitted into its ends. The inner tools 12 can be rotated about their longitudinal axis. Interacting with the inner tools 12 is an outer tool 13 constituted as a roller that is mounted rotatably on a pivot arm 14. This pivot arm 14 is controlled by a drive comprised of a motor 15 and a step-down transmission 16 and by an angle or increment sensor 17. The angle sensor 17 is preferably of the absolute type that allows one to determine the actual angular pivot-arm position even if power is lost. A central controller 18 operates the motor 15 in accordance with the angular movement or travel, which for example can be linear, progressive, regressive, or the like, and the desired position, in particular the starting and ending points of the pivotal movement according to previously determined parameters. The output of the incremental or angle sensor 17 allows the actual position to be determined during operation. A display 19 shows the control data and parameters; new parameters for the controller 18 can also be inputted there.

Figure 2:
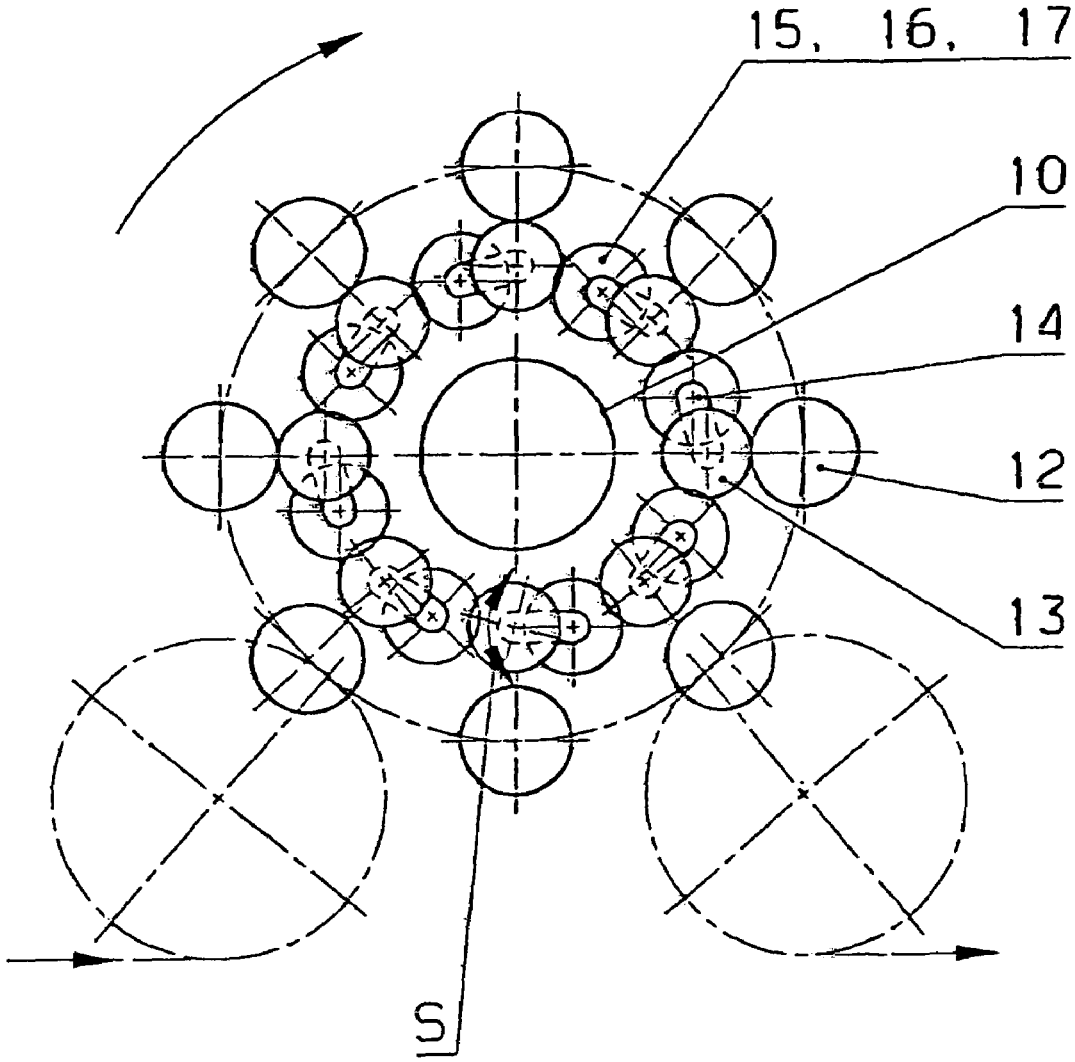
FIG. 2 is a top view of a multiple-spindle rotation machine with several shaping tools.

FIG. 2 shows the arrangement of the controller drive and the pivot arm in a multiple-spindle carousel-type machine with eight inner tools 12 each associated with a respective outer tool 13 carried on a respective pivot arm 14. Each tool 13 has a pivot arc S and can be moved toward and away from the respective inner tool 12 by a respective drive 15, 16, 17. Each individual one of the n drives (see controller 18) is independent of the others. In the center of the machine is a calibrating ring 10 that serves with each machine cycle for automatic resetting of the tools 13 in that each arm 14 is pivoted in the same direction until its roller tool touches the calibrating ring and the angle sensor 7 sets the respective pivot axis to "0."

Figure 3:
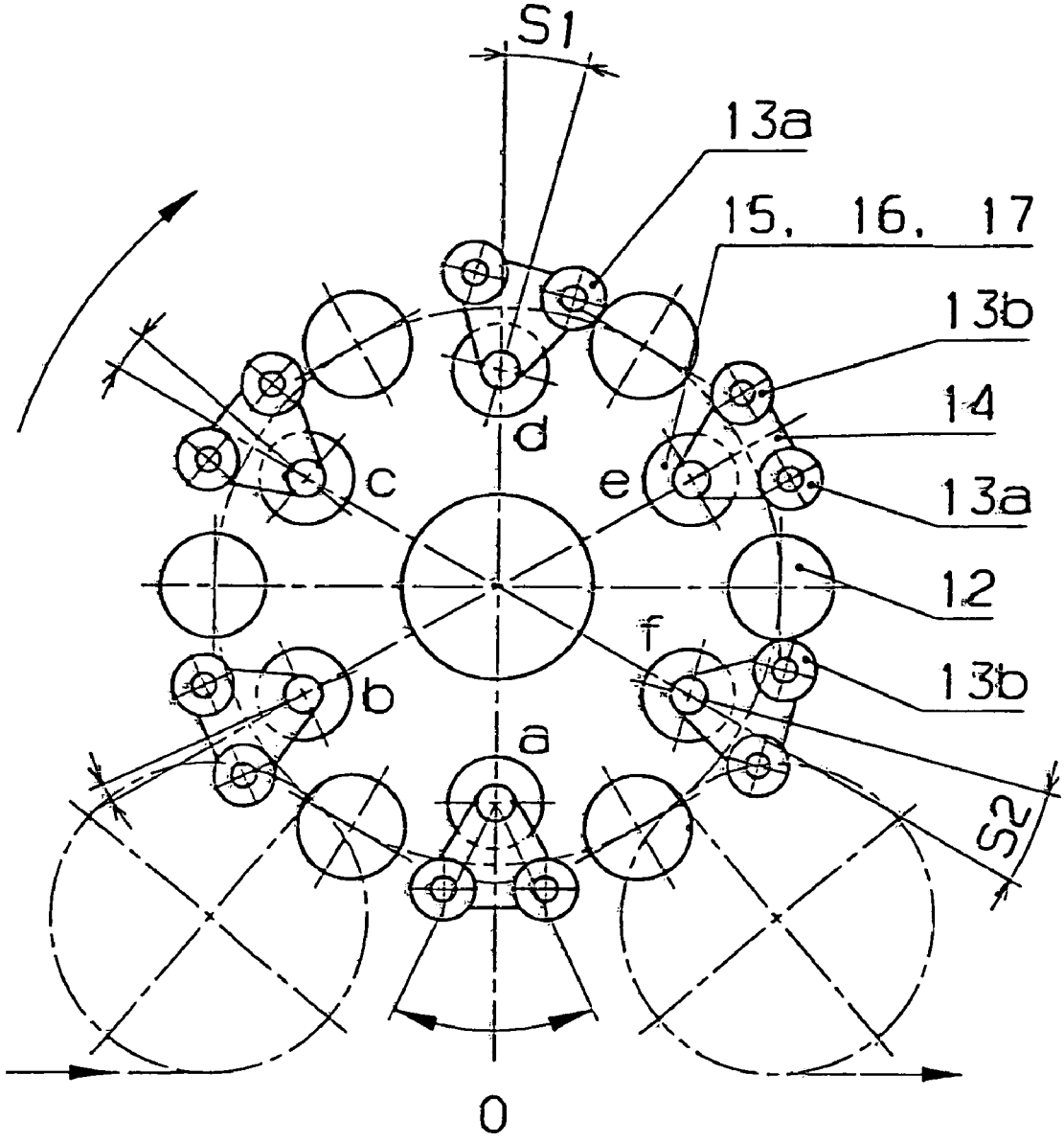
FIG. 3 is a top view of a variant on the multiple-spindle machine of FIG. 2.

FIG. 3 shows a variation on the multiple-spindle carousel-type machine of FIG. 4 for a two-stage shaping process. Each pivot arm 14 carries at its outer end two tool rolls 13*a* and 13*b* serving as shaping tools and having different profiles. The pivot arms 14 are operated by drives 15, 16, 17. Position a is the neutral (zero) position in which both outer tools 13*a* and 13*b* are spaced from the can body carried on an inner tool 12. After pivoting through an arc S1 (see positions b to d) the outer tool roller 13*a* engages the can body 12 on the inner tool 12. Once the shaping operation is done, the appropriate pivot arm 14 is moved back past through the null position (see position e) and is moved through the pivot arc S2 into position f in which the second outer tool roller 13*b* engages the cam body engaged on the inner tool 12. The relationship of the control times for the start and end of the pivot arcs S1 and S2 is freely selectable. The cyclical movement of each pivot arm 14 is constituted of movement in different directions. In a first step, that is when pivoting through the arc S1, the tool roller 13*a* is moved from the neutral center position into a working position. In the succeeding second step a further shaping or folding operation is effected by pivoting through the arc S2. The apparatus shown in FIG. 3 can work on cans of different diameters without changing tools.

The invention claimed is:

1. An apparatus for shaping can bodies, the apparatus having at least two oppositely rotating shaping tools of which one is mounted on an outer end of an arm for radial movement, the arm being provided with a controllable drive comprised of a motor and sensor means for detecting a position of the outer end of the arm.

2. The apparatus according to claim 1 wherein the arm is pivotal.

3. The apparatus according to claim 2 wherein there are a plurality of the arms each provided with two tools that are used alternately for shaping.

4. The apparatus according to claim 1 wherein there are a plurality of such arms each connected with a respective such externally controllable drive.

5. The apparatus according to claim 1, further comprising control means comparing change in an actual-value current output of the electrical drive relative to an angular position of the arm, deriving therefrom a force curve, and comparing the derived force curve with a stored force curve and, when a predetermined deviation is detected, culling out the respective can body.

6. The apparatus according to claim 5, further comprising a memory for the force curves of typical error situations.

7. The apparatus according to claim 1, further comprising a step-down transmission between the motor and the arm.

8. The apparatus according to claim 1 wherein the sensor means is an angular-position detector.

9. The apparatus according to claim 1 wherein the sensor means is an increment detector.

10. An apparatus for shaping can bodies, the apparatus having at least two oppositely rotating shaping tools of which one is mounted on an outer end of an arm for radial movement, the arm being provided with a controllable drive comprised of a motor and sensor means for detecting a position of the outer end of the arm, the apparatus further comprising a calibrating body that serves after changing of one of the shaping tools as a reference point for setting at a null point the sensor means.

11. An apparatus for shaping a can body, the apparatus comprising:

an inner shaping tool fittable inside the can body;

a freely rotatable outer shaping tool outside the can body;

an arm having an outer end rotatably carrying the outer shaping tool and an inner end, the arm being pivotal about its inner end;

means for rotating the inner tool and the can body fitted thereto about an axis and thereby also entraining and rotating the outer tool;

a motor connected to the arm for controlledly pivoting the arm and thereby controlledly moving the outer shaping tool toward and away from the inner shaping tool;

a position detector connected to arm for sensing the angular position thereof and the relative spacing of the inner and outer tools; and control mean including a memory for controlling the motor in accordance with a sensed angular position of the arm.

* * * * *